United States Patent [19]

Vera et al.

[11] 4,205,831

[45] Jun. 3, 1980

[54] ORE REDUCTION REACTOR DISCHARGE REGULATOR

[75] Inventors: Enrique R. M. Vera; Gilberto G. Garcia, both of Monterrey, Mexico

[73] Assignee: Hylsa, S. A., Monterrey, Mexico

[21] Appl. No.: 26,874

[22] Filed: Apr. 4, 1979

[51] Int. Cl.[2] ..... C21B 7/14

[52] U.S. Cl. ..... 266/195

[58] Field of Search ..... 266/195, 182, 191

[56] References Cited

U.S. PATENT DOCUMENTS

| | | | |
|---|---|---|---|
| 2,684,869 | 7/1954 | Lapple | 222/637 |
| 3,601,381 | 8/1971 | Beggs | 266/195 |
| 3,836,131 | 9/1974 | Beggs | 266/195 |
| 3,876,383 | 4/1975 | Vandenhoeck | 23/284 |
| 3,878,096 | 4/1975 | Somogyi | 210/110 |
| 3,990,857 | 11/1976 | Vandenhoeck | 23/284 |
| 4,071,452 | 1/1978 | Friese | 210/189 |
| 4,129,289 | 12/1978 | Miyasita et al. | 266/195 |

*Primary Examiner*—M. J. Andrews

*Attorney, Agent, or Firm*—Curtis, Morris & Safford

[57] ABSTRACT

A discharge flow regulating device for regulating the discharge of sponge metal from the bottom of a vertical, moving bed reduction reactor. A frustoconical baffle near the bottom of the reactor directs the flow of particles toward a horizontal plate spaced from the baffle and having a diameter sufficient to block the passage of the particles. Gas under pressure is supplied to the center of the plate and directed radially outward to blow particles over the rim of the plate. The supply of pressurized gas is regulated to regulate the rate at which particles are forced to and over the perimeter of the plate. The gas also serves to cool the sponge metal in the lower portion of the reactor.

5 Claims, 3 Drawing Figures

FIG. 1
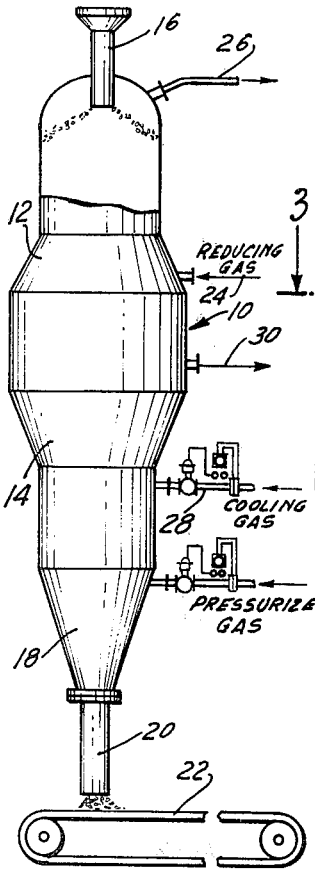
FIG. 2
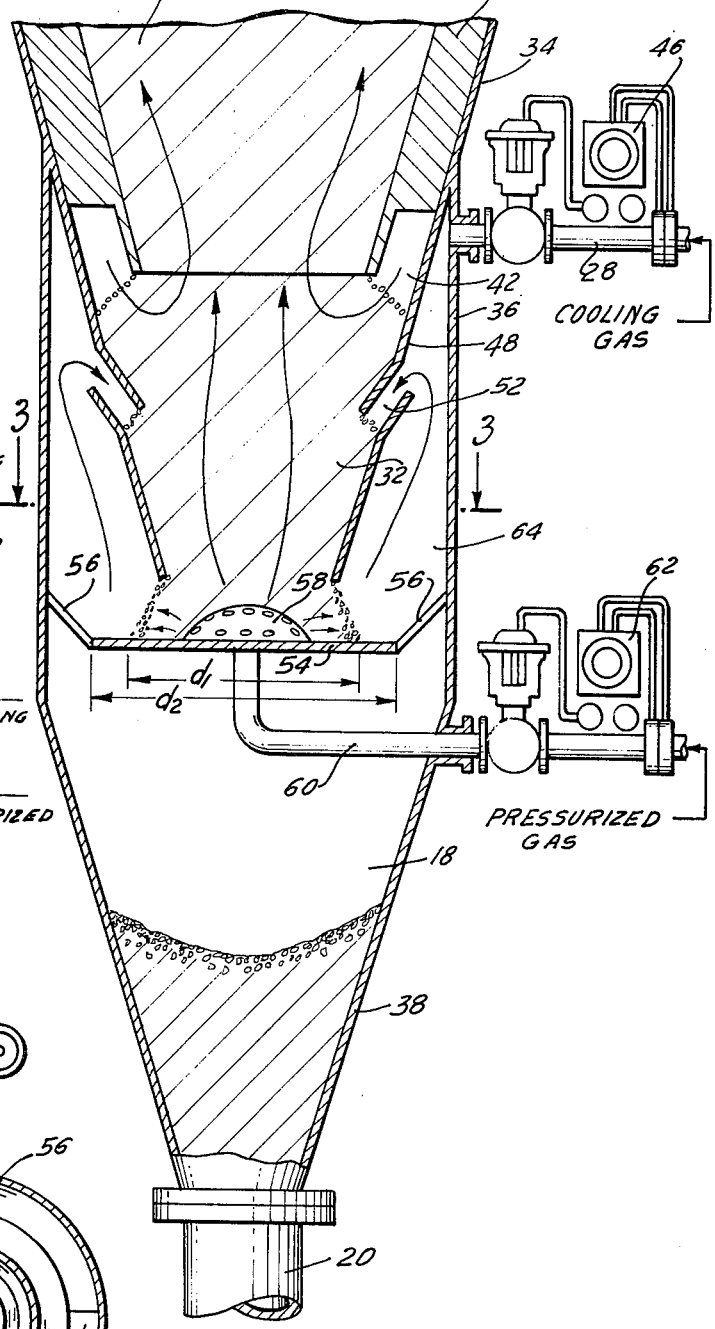
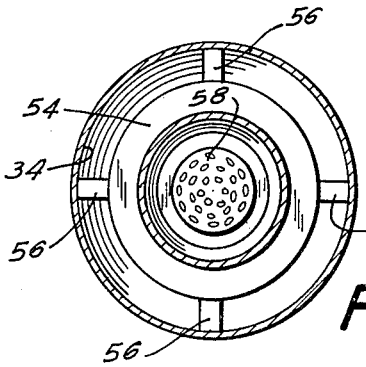
FIG. 3

ORE REDUCTION REACTOR DISCHARGE REGULATOR

This invention relates to ore reduction reactors of the type in which oxidic ores, e.g., iron ores in particulate form, are reduced by direct contact with a reducing gas to form sponge metal particles. More particularly, the invention relates to a novel pneumatically operated arrangement for regulating the rate of flow of metal-bearing particles through such a reactor. For convenience the apparatus will be described herein as used in the reduction of iron ore to sponge iron. However, as the description proceeds, it will become apparent that the apparatus can equally well be used in the reduction of other oxidic ores to produce sponge metal.

Reactors of the type with which the present invention is concerned are shown, for example, in U.S. Pat. Nos. 3,765,872, 3,779,741 and 4,099,962. In general such reactors comprise an inlet at the top of the reactor for fresh ore to be reduced, a reduction zone in the upper part of the reactor wherein the ore is reduced by contact with a hot reducing gas, a cooling zone in the lower part of the reactor wherein the sponge metal is cooled by contact with a cooling gas, and a discharge outlet at the bottom of the reactor. At or near the outlet a flow regulating device of some sort is provided for regulating the flow of particulate material through the reactor to make sure that the residence time of the metal-bearing particles in the reduction zone and the cooling zone is such as to provide adequate reduction of the ore and cooling of the sponge iron.

Normally the ore charged to the top of such a reactor varies substantially in its particle size and there is a tendency for the particles to become segregated with the larger particles at the periphery of the reactor and the fine particles near the center of the reactor. Such an uneven distribution of the ore particles produces a corresponding irregularity in the resistance to gas flow in the bed and consequently a variation in the linear rate of gas flow and in the reduction rate and cooling rate at different points in the cross-section of the reactor. In the cooling zone of the reactor this phenomenon may cause uneven cooling and/or re-oxidation of the sponge iron particles.

Another problem encountered in the operation of such a reactor arises out of the fact that the means commonly used for regulating the discharge of particles from the reactor involves causing the particulate material to flow in a converging stream toward a valve or the like having moving parts which tend to break up the pellets as they pass therethrough, thereby generating an undesirably high proportion of fine particles.

It is accordingly an object of the present invention to provide a moving bed reduction reactor having an improved particle discharge means. It is another object of the invention to provide a discharge regulating device that does not tend to fracture the sponge iron particles and produce an excessive amount of fine particles. It is still another object of the invention to provide a discharge regulating device that has no moving parts. It is a still further object of the invention to provide apparatus that improves both regulation of the discharge of the sponge iron and cooling of the sponge iron before it is discharged. Other objects of the invention will be in part obvious and in part pointed out hereafter.

The many objects and advantages of the present invention can best be understood and appreciated by reference to the accompanying drawings wherein:

FIG. 1 is a diagrammatic general elevation of a moving bed reactor incorporating a preferred embodiment of the present invention;

FIG. 2 is a vertical section through the lower part of the reactor particularly showing the lower portion of the cooling zone and the arrangement of the flow controlling distributor plate and nozzle therein;

FIG. 3 is a horizontal section through the lower portion of the reactor taken on the line 3—3 of FIG. 2 and further showing the relationship between the perforated nozzle, guide baffle and distributor plate.

Referring to the drawing, FIG. 1 generally shows a moving bed, vertical shaft reduction reactor 10 having a reduction zone 12 in the upper portion thereof and a cooling zone 14 in the lower portion thereof. The ore to be reduced is fed to the reactor through an inlet 16 and flows downwardly through the reactor. Within the reactor the ore is reduced to sponge iron by direct reduction with a hot reducing gas. The resulting sponge iron flows through cooling zone 14 to a discharge zone 18, thence out of the reactor through a discharge pipe 20 to a conveyor 22 by which it is carried to a suitable storage point or point of use.

Hot reducing gas is supplied to the bottom of the reduction zone 12 by a pipe 24 and flows upwardly counter-current to the descending ore. Spent reducing gas is removed from the reactor through pipe 26. Within the cooling zone 14 sponge iron formed by reduction of the ore is cooled by a cooling gas delivered to a point near the bottom of the cooling zone by a pipe 28, whence it flows upwardly through the descending sponge iron. The cooling gas is withdrawn near the top of the cooling zone through a pipe 30.

The discharge regulating device of the present invention is incorporated in the lower portion of the reactor and is best shown in FIG. 2 of the drawings. As shown in FIG. 2, interposed between the cooling zone 14 and the discharge zone 18 there is a sponge iron accumulation chamber 32. The converging lower end of the cooling zone 14 is partially defined by a frustoconical wall portion 34 that extends downwardly into a cylindrical section 36 of the reactor which in turn merges into the converging wall 38 of the discharge chamber 18.

The wall 34 of the cooling zone 14 is provided internally with a layer of insulation 40 which at its lower end is notched to form an annular channel 42. As previously described, cooling gas is supplied through pipe 28 to the bottom of the cooling zone and more particularly to the channel 42 from which it flows around the lower inner rim of the channel and as indicated by the arrows in FIG. 2 upwardly through the body of sponge iron in cooling zone 14. Pipe 28 is provided with a flow controller 46 to facilitate regulation of the cooling gas fed through the channel 42 to the bottom of the cooling zone.

The converging wall 34 of cooling zone 14, which extends downwardly into the cylindrical section 36 of the reactor, forms a tubular frusto-conical baffle 48 that extends into and nests within the upper end of a second frusto-conical baffle 50. The lower end of baffle 48 is spaced from the upper end of baffle 50 to form an annular passage 52 therebetween and the two baffles cooperate to guide the descending body of sponge iron toward the central portion of the reactor.

Confronting the lower end of the baffle 50 there is a substantially horizontal distributor plate 54 which acts as a blocking member to block the downward flow of sponge iron particles. The particles in effect pile up on the distributor plate and the relationship between the normal angle of repose of the particles and diameter of the distributor plate is such that in the absence of some disturbing influence the downward flow of particles is blocked by the plate. As shown in FIG. 2, the diameter $d_1$ of the base of the heap of particles on the plate when the particles are in repose is less than the diameter $d_2$ of the distributor plate.

The plate 54 is supported from the wall of the cylindrical section 36 by a series of spaced brackets 56. Centrally mounted on the plate 54 there is a perforated nozzle 58 which is supplied with a cool pressurized gas by a pipe 60 that extends through the wall of the reactor, in particular through the wall 38 of discharge chamber 18. The plate 54, nozzle 58 and gas supply pipe 60 cooperate to form a flow regulating means for regulating the flow of sponge iron out of the reactor. As the gas supplied through pipe 60 flows through the perforations of the nozzle 58, it exerts a radially outward pressure on the pile of sponge from particles that have accumulated on plate 54 and forces them outwardly over the rim of the plate 54, whereupon they drop into the chamber 18 for removal from the reactor through the outlet 20. By varying the rate of flow of gas through pipe 60 and through nozzle 58, the rate of discharge of particles over the perimeter of plate 54 and into the discharge chamber can be effectively regulated. Pipe 60 is provided externally of the reactor with a flow controller 62 to facilitate regulation of the flow of gas through pipe 60 and nozzle 58.

Gas that flows radially outward from nozzle 58 to push sponge iron particles over the rim of plate 54 thereafter flows upwardly through an annular passage 64, thence downwardly and inwardly through passage 52 to the body of descending sponge iron and then upwardly through the sponge iron body to cool it. If additional cooling is desired, both the top and sides of the nozzle 58 can be perforated to cause a portion of the cool pressurized gas to flow directly up through the descending body of sponge iron within the frusto-conical baffle 50 as indicated by the arrows in FIG. 2.

Any of various gases and gaseous mixtures can be used as the cooling gas supplied to pipe 28 and the pressurized gas supplied to pipe 60. It is sometimes desirable to carburize the sponge iron in the cooling reactor and in such cases the coolant gas should be a CO-containing gas such as the reducing gas commonly used in the reduction zones of gaseous reduction reactors. Other gases that can be used are nitrogen, carbon dioxide, methane and fossil fuel combustion products. The pressurized gas supplied through pipe 60 may be of the same type as the cooling gas or may differ therefrom. Gases containing elemental oxygen should be avoided to prevent re-oxidation of the sponge iron.

From the foregoing description it should be apparent that applicants have provided a discharge regulating device capable of meeting the objectives set forth above. A simple and effective control device is provided with no moving parts that might disintegrate the sponge iron particles. The device may be used both to regulate the sponge iron flow and to provide supplemental cooling thereof.

It is of course to be understood that the foregoing description is intended to describe only a specific illustrative embodiment of the invention and that numerous changes can be made therein without departing from the spirit of the invention as defined in the appended claims. For example, the present device can be used to control the discharge of particles from reactors carrying out the reduction of ores other than iron ores, e.g., copper, nickel or tin ores. Also the reactor may be operated under pressure, if desired, using pressure locks of the type described in U.S. Pat. No. 3,710,808.

We claim:

1. In a vertical shaft, moving bed reduction reactor having a reduction zone in the upper part thereof and a cooling zone in the lower part thereof, said reactor being of the type in which particulate oxide ore is reduced by a stream of reducing gas in said reduction zone and then cooled by a stream of cooling gas in said cooling zone to form cooled particles of sponge metal, apparatus for regulating the discharge of said particulate sponge metal from said reactor comprising in combination with said reactor a downwardly converging tubular baffle in said cooling zone for guiding the sponge metal particles toward the center of said reactor, a flow blocking member confronting the discharge end of said baffle and positioned to accumulate a sufficient amount of cooled sponge metal particles to prevent further flow from said converging baffle, a perforated nozzle near the center of said flow blocking member and means for supplying pressurized gas to said nozzle to cause said gas to blow particles outwardly over the perimeter of said flow blocking member whereby the particles blown from said blocking member fall downwardly toward the discharge end of said reactor.

2. In a vertical shaft, moving bed ore reduction reactor having a reduction zone in the upper part thereof and a cooling zone in the lower part thereof, said reactor being of the type in which particulate oxide ore is reduced by a stream of reducing gas in said reduction zone and then cooled by a stream of cooling gas in said cooling zone to form cooled particles of sponge metal, apparatus for regulating the discharge of said particulate sponge metal from said reactor comprising in combination with said reactor a downwardly converging tubular baffle in said cooling zone for guiding the sponge metal particles toward the center of said reactor, a distributor plate confronting the discharge end of said baffle and spaced a predetermined distance therefrom whereby said particles form a heap on said plate having a base area less that the area of said plate, a perforated nozzle near the center of said plate, means for supplying gas under pressure to said nozzle to cause gas passing through said nozzle to blow particles from said heap outwardly over the periphery of said distributor plate, whereby said particles drop toward the discharge end of said reactor and regulating means for varying the gas supply to said nozzle to vary the rate at which metal particles are blown off said plate.

3. Apparatus according to claim 2 and wherein said nozzle has both lateral holes for blowing particles over the periphery of said distributor plate and vertical holes for supplying cooling gas to the body of particulate sponge metal in said cooling zone.

4. In a vertical shaft, moving bed ore reduction reactor having a reduction zone in the upper part thereof and a cooling zone in the lower part thereof, said reactor being of the type in which particulate oxide ore is reduced by a stream of reducing gas in said reduction zone and then cooled by a stream of cooling gas in said cooling zone to form cooled particles of sponge metal, apparatus for regulating the discharge of said particulate sponge metal from said reactor comprising in combination with said reactor a downwardly converging frusto-conical baffle for guiding the sponge metal particles toward the center of said reactor, a circular distributor plate confronting the discharge end of said baffle and spaced a predetermined distance therefrom whereby said particles form a heap on said plate having a maximum diameter less than the diameter of said plate, a perforated nozzle mounted on said plate near the center thereof, a conduit for supplying gas under pressure to the interior of said nozzle and regulating means in said conduit for varying the gas supply to said nozzle to vary the rate at which metal particles are blown off said plate and fall to the discharge end of said reactor.

5. Apparatus according to claim 2 and wherein the converging baffle is spaced throughout its length from the interior wall of the reactor whereby the gas used to blow sponge metal particles over the periphery of said distributor plate may flow upwardly between said baffle and the interior of said reactor and thence inwardly over the top of said baffle into and through the mass of sponge metal particles in said cooling zone.

* * * * *

UNITED STATES PATENT AND TRADEMARK OFFICE

CERTIFICATE OF CORRECTION

PATENT NO. : 4,205,831

DATED : June 3, 1980

INVENTOR(S) : ENRIQUE R.M. VERA, GILBERTO G. GARCIA

It is certified that error appears in the above-identified patent and that said Letters Patent are hereby corrected as shown below:

In the drawings, Fig. 2, pipe 28 which extends through the wall of the cylindrical section 36 should extend also through the wall 34 to open for the first time in a supply cooling gas directly to the annular channel 42.

In the drawings, Fig. 2, directly below the tubular frusto-conical baffle 48 formed from the wall 34, the second frusto-conical baffle should be labeled 50.

Signed and Sealed this

*Seventh* Day of *April 1981*

[SEAL]

*Attest:*

RENE D. TEGTMEYER

*Attesting Officer* *Acting Commissioner of Patents and Trademarks*